US012553646B2

(12) United States Patent
Guia et al.

(10) Patent No.: US 12,553,646 B2
(45) Date of Patent: Feb. 17, 2026

(54) DILUTION REFRIGERATION DEVICE AND METHOD

(71) Applicant: L'Air Liquide, Societe Anonyme pour l'Etude et l'Exploitation des Procedes Georges Claude, Paris (FR)

(72) Inventors: Olivier Guia, Sassenage (FR); Marc Stora, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 237 days.

(21) Appl. No.: 18/267,354

(22) PCT Filed: Nov. 30, 2021

(86) PCT No.: PCT/EP2021/083496
§ 371 (c)(1),
(2) Date: Jun. 14, 2023

(87) PCT Pub. No.: WO2022/128434
PCT Pub. Date: Jun. 23, 2022

(65) Prior Publication Data

US 2024/0093916 A1 Mar. 21, 2024

(30) Foreign Application Priority Data

Dec. 18, 2020 (FR) ..... FR 2013599

(51) Int. Cl.
*F25B 9/12* (2006.01)
*F25B 41/40* (2021.01)

(52) U.S. Cl.
CPC ..... *F25B 9/12* (2013.01); *F25B 41/40* (2021.01); *F25B 2500/12* (2013.01); *F25B 2500/13* (2013.01)

(58) Field of Classification Search
CPC .... F25B 9/12; F25B 9/14; F25B 9/145; F25B 2500/13; F25B 2309/1427;
(Continued)

(56) References Cited

U.S. PATENT DOCUMENTS 6,915,642 B2 * 7/2005 Ravex ..... F25B 9/10 62/6
8,464,542 B2 * 6/2013 Hilton ..... H10N 60/80 62/46.1
(Continued)

FOREIGN PATENT DOCUMENTS

CN 111854214 A * 10/2020 ..... F25B 9/14
FR 2914050 9/2008
JP 2007 333 273 12/2007

OTHER PUBLICATIONS

CN-111854214-A English Translation (Year: 2020).*
(Continued)

*Primary Examiner* — Frantz F Jules
*Assistant Examiner* — Devon Moore
(74) *Attorney, Agent, or Firm* — Justin K. Murray

(57) ABSTRACT

Dilution refrigeration device having a support member, a fluid-tight enclosure, an open end of the fluid-tight enclosure being mechanically connected to the support member via a flexible fluid-tight bellows, an upper end of a cryogenerator being secured to the support member, the device further having a fluid-tight sheath which is received in the enclosure, a lower end of the cryogenerator extending in the fluid-tight sheath inside the fluid-tight flexible bellows so that the enclosure and the fluid-tight sheath are at least partially mechanically insulated from the vibrations generated by the cryogenerator.

14 Claims, 2 Drawing Sheets

(58) Field of Classification Search
CPC ..... F25B 2309/1412; F25B 2309/1414; F25B 2309/1417; F25B 2309/1421; F17C 3/08; F17C 3/085
USPC ..... 62/610
See application file for complete search history.

(56) References Cited

U.S. PATENT DOCUMENTS

| | | | | |
|---|---|---|---|---|
| 11,796,228 | B2 * | 10/2023 | Wada | F28F 21/02 |
| 2007/0121272 | A1 * | 5/2007 | Vladimir | F25B 17/086 361/276 |
| 2009/0293505 | A1 * | 12/2009 | Wang | F25D 19/00 62/51.1 |
| 2011/0185766 | A1 * | 8/2011 | Benoit | F25B 9/12 62/610 |
| 2014/0202174 | A1 | 7/2014 | Wang | |
| 2023/0104504 | A1 * | 4/2023 | Watanabe | F25B 9/10 62/56 |

OTHER PUBLICATIONS

International Search Report and Written Report for PCT/EP2021/083496, mailed Feb. 10, 2022.
French Search Report for FR 2 013 599, mailed Aug. 13, 2021.
Uhlig, et al., "3He/4H3 dilution refrigerator precooled by Gifford-McMahon refrigerator," Cryogenics, Elsevier, Kidlington, GB, vol. 37, No. 5, May 1, 1997, pp. 279-282.

* cited by examiner

DILUTION REFRIGERATION DEVICE AND METHOD

CROSS REFERENCE TO RELATED APPLICATIONS

This application is a § 371 of International PCT Application PCT/EP2021/083496, filed Nov. 30, 2021, which claims the benefit of FR2013599, filed Dec. 18, 2020, both of which are herein incorporated by reference in their entireties.

FIELD OF THE INVENTION

The invention relates to a dilution refrigeration device and method.

The invention relates in particular to a low-temperature or very-low-temperature (meaning potentially down to the temperature range from one to around 100 millikelvin) cryogenic refrigeration device and method.

BACKGROUND OF THE INVENTION

Indeed, the traditional means of obtaining the refrigeration power at temperatures of around one millikelvin to around 100 millikelvin is the helium-3/helium-4 dilution refrigerator.

Document FR2914050A1 describes a cryogenerator-type cooling system used in a dilution refrigeration device.

The coupling (thermal and mechanical link) of a cryogenerator with a dilution refrigeration device is, however, likely to transmit vibrations to the dilution refrigeration device. These vibrations are harmful because they give rise to overconsumption of power or overheating and parasitic noises on the object cooled by the dilution refrigeration device.

Moreover, the known devices are relatively complex and bulky due to the numerous fluid circuits required.

An aim of the present invention is to overcome all or some of the drawbacks of the prior art set out above.

SUMMARY OF THE INVENTION

In certain embodiments, the invention relates more particularly to a dilution refrigeration device comprising a working circuit in the form of a loop containing a cycle fluid, the cycle fluid comprising a mixture of helium-3 (3He) and helium-4 (4He), the working circuit comprising a mixing chamber, a boiler and a transfer member, which are disposed in series and fluidically connected via a set of lines, the circuit being configured to connect an outlet of the mixing chamber to an inlet of the boiler and an outlet of the boiler to an inlet of the transfer member, the circuit also being configured to connect an outlet of the transfer member to an inlet of the mixing chamber, the device further comprising at least one cooling member which is in heat exchange with the working circuit and is configured to transfer cold energy to the cycle fluid, the at least one cooling member comprising a cryogenerator for example of the Gifford-McMahon or pulse tube type, the device comprising a support, a fluid-tight enclosure (9), In an effort to overcome the deficiencies of the prior art discussed supra, the device according to the invention, which is otherwise in accordance with the generic definition thereof given in the above preamble, can include an open end of the enclosure that is mechanically connected to the support via a fluid-tight flexible bellows, an upper end of the cryogenerator being fixed to the support, the device further comprising a fluid-tight sheath housed in the enclosure, a lower end of the cryogenerator extending in the sheath inside the bellows such that the enclosure and the sheath are at least partially mechanically insulated from vibrations generated by the cryogenerator, the working circuit comprising a fluid injection line connecting an outlet of the transfer member to an inlet of the mixing chamber via a fluid-tight passage in the sheath, the injection line being mechanically decoupled from the cryogenerator and from the support, that is to say that the injection line is at least partially mechanically insulated from the vibrations generated by the cryogenerator, and in that the working circuit comprises a set of return pipes connecting an outlet of the boiler to an inlet of the transfer member outside the enclosure via a cycle gas passage in the sheath, in which passage the cycle fluid emerges and circulates in the volume of the sheath in contact with the lower end of the cryogenerator.

The device according to the invention therefore operates with a cryogenerator, but without the cold dilution part being subjected or too sensitive to the vibrations of the cryogenerator.

In addition, the system is compact and can use only the one same single fluid for the working fluid and the atmosphere in the sheath.

Furthermore, embodiments of the invention may comprise one or more of the following features:

- the injection line is in heat exchange with the cryogenerator and with the cycle fluid which circulates in the sheath between the outlet of the boiler and the inlet of the transfer member,
- the set of return lines comprises a first portion of return line opening out into the sheath at a lower end of the sheath in order to inject the cycle gas therein, and a second portion of return line having a lower end communicating with an upper end of the sheath in order to collect the cycle gas,
- the lower end of the cryogenerator comprises at least one heat exchanger for cooling cycle gas, the first portion of return line opening out below said heat exchanger in order for the flow of cycle fluid injected into the sheath to be oriented in contact with the at least one heat exchanger,
- the at least one heat exchanger comprises, within its thickness, one or more passages, for example orifices and/or fins oriented in the vertical direction to accommodate at least part of the cycle gas flow emerging via the first portion of return line,
- the set of return lines is mechanically decoupled from the cryogenerator and from the support, that is to say at least partially mechanically insulated from the vibrations generated by the cryogenerator,
- the injection line is fixed to an inner wall of the sheath and/or suspended in the sheath,
- the mixing chamber and the boiler are mounted in a shell and/or a container that are/is located in the enclosure, the transfer member being located outside the enclosure,
- in an operating configuration, the lower end of the cryogenerator comprises a first portion cooled to a first temperature of between 4 and 100 K and for example equal to 50 K, and a second portion cooled to a second temperature of between 2 and 8 K and for example equal to 4 K,
- the at least one cooling member comprises an additional cooling system located at the inlet upstream of the boiler, for example a cooler of the Joule-Thomson type, the support comprises a first base mounted on a first set of legs, for example three legs, the support comprises a second base located under the first base and mounted on a second set of legs, for example three legs, the two ends of the bellows (10) being connected respectively to the first base and second base, the enclosure is mechanically connected to the second base.

In another embodiment, the invention can also relate to a dilution refrigeration method using a device according to any one of the features above or below, comprising a step of generating cold by way of the cryogenerator, a step of circulating the cycle fluid in the working circuit, the method further comprising at least one step from among: regulating the quantity of gas in the sheath, regulating the pressure in the sheath to a determined value, for example close to atmospheric pressure and notably between 0 and 2 bar, regulating the pressure in the sheath to a pressure corresponding to the liquefaction pressure of helium-4 at the coldest temperature of the cryogenerator.

The invention may also relate to any alternative device or method comprising any combination of the features above or below within the scope of the claims.

BRIEF DESCRIPTION OF THE DRAWINGS

These and other features, aspects, and advantages of the present invention will become better understood with regard to the following description, claims, and accompanying drawings.

It is to be noted, however, that the drawings illustrate only several embodiments of the invention and are therefore not to be considered limiting of the invention's scope as it can admit to other equally effective embodiments.

DETAILED DESCRIPTION OF THE INVENTION

Figure 1:
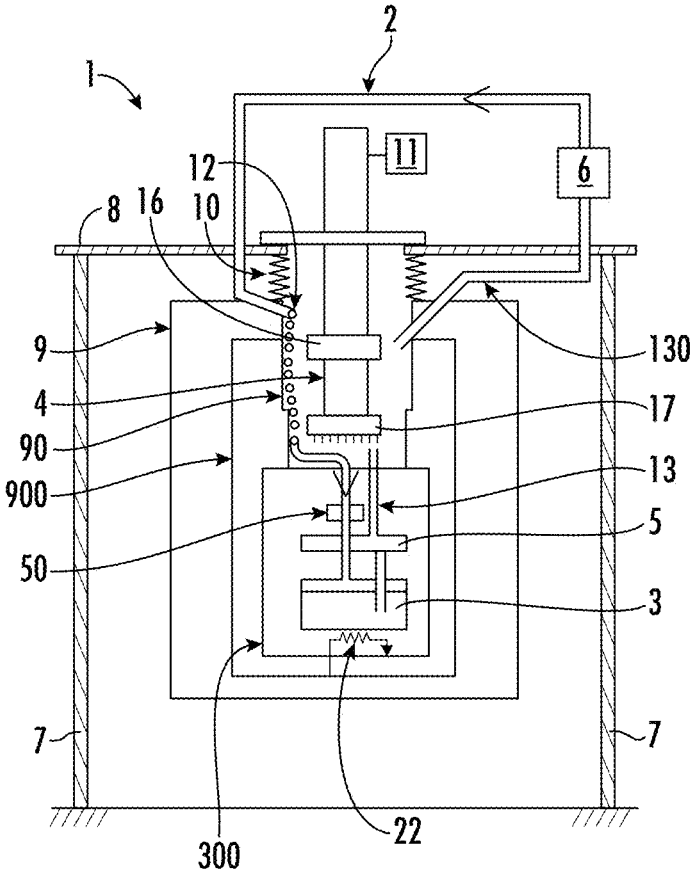
FIG. 1 shows a schematic and partial view illustrating a possible example of the structure and operation of a device according to the invention.

The dilution refrigeration device 1 illustrated in [FIG. 1] comprises a working circuit 2 in the form of a loop containing a cycle fluid. This cycle fluid comprises a mixture of helium-3 (3He) and helium-4 (4He).

This working circuit 2 forms, for example, a closed loop and comprises a mixing chamber 3, a boiler 5 and a transfer member 6 (for example a pump or other device), which are disposed in series and connected fluidically via a set of lines 12, 13, 130. The set of lines of the working circuit 2 is in particular configured to connect an outlet of the mixing chamber 3 to an inlet of the boiler 5 and an outlet of the boiler 5 to an inlet of the transfer member 6.

In addition, the set of lines of the circuit 2 is also configured to connect an outlet of the transfer member 6 to an inlet of the mixing chamber 3. Conventionally, a heat exchange portion (not shown for the sake of simplification) may be provided between the countercurrent lines between the mixing chamber 3 and the boiler 5.

The device 1 further comprises at least one cooling member which is in heat exchange with the working circuit 2 and which is configured to transfer cold energy to the cycle fluid (that is to say to cool said cycle fluid by supplying cooling power to it).

Such a dilution system makes it possible to generate very low temperatures at the mixing chamber 3. This can be used conventionally to cool an application (shown schematically by the reference 22) and which can notably have a power to be dissipated that varies over time.

Temperatures in the range between one millikelvin and 100 millikelvin can notably be achieved.

The cooling member comprises a cryogenerator 4, for example of the Gifford-McMahon or pulse tube type (but any other suitable cryogenic cold production unit can be envisaged).

The device 1 comprising a support 7, 8 and a fluid-tight enclosure 9.

The enclosure 9 comprises, for example, a fluid-tight tank (typically made of stainless steel, aluminum, or any other suitable material) having an open end connected to the support 7, 8 in a mechanical and fluid-tight manner via a fluid-tight flexible bellows 10. The flexible bellow 10 is for example formed of corrugations made of hydroformed stainless steel. Of course, any other type of vibration damping and/or filtering connection could replace or supplement the aforementioned bellows 10, for example edge welded bellows or an elastomer sleeve. For example, the support comprises a base 8 which is horizontal in a use position and which is mounted on a first set of legs 7, for example three legs 7.

The cryogenerator 4 is fixed to the support 7, 8, for example by screwing.

As illustrated, an upper end of the cryogenerator 4 can be mounted on the base 8 of the support (notably in a fluid-tight manner through the base 8).

The device 1 further comprises a fluid-tight sheath 90 that is housed in the enclosure 9 and that also forms a fluid-tight closed volume.

For example, the internal volume of the enclosure 9 is under vacuum (at a pressure lower than the external pressure).

For example, the sheath 90 comprises or is made up of a fluid-tight metallic tank or shell. The sheath 90 is for example fixed to an upper end of the enclosure 9. For example, an open upper end of the sheath 90 is suspended or connected to an upper end of the enclosure 9 (if necessary via a connection or a vibration damping element). A lower end of the cryogenerator 4 extends in the sheath 90 inside the bellows 10 (and therefore in the enclosure 9 which houses them).

According to this arrangement, the enclosure 9 and the sheath 90 (and the components they contain) are at least partially mechanically insulated from the vibrations generated by the cryogenerator 4 (by virtue notably of the bellows 10).

The mixing chamber 3 and the boiler 5 can be housed/mounted in a fluid-tight shell 900 located in the enclosure 9 and notably in a container 300 housed in this shell 900.

The transfer member 6 is located outside the enclosure 9. For example, the volume of the shell 900 forms a volume which may or may not communicate with the volume of the sheath 90.

Preferably, the volumes of the enclosure 9, of the shell 900 and of the container 300 are under vacuum and communicate with each other but do not communicate with the volume of the sheath 90 which is under an independent atmosphere (the volume of the sheath 90 contains for example at least one from among: He3, He4).

The working circuit 2 comprises a cycle fluid injection line 12 (which may be a cupronickel or copper capillary, for example) connecting an outlet of the transfer member 6 to an inlet of the mixing chamber 3 via a (fluid-tight) passage in the sheath 90 and in the enclosure 9. The injection line 12 is in heat exchange with the cryogenerator 4 (which cools it). For example, the cryogenerator 4 comprises plates and/or cooling exchangers 16, 17 in contact with cold parts of the cryogenerator 4.

For example, in the operating configuration, the lower end of the cryogenerator 4 in the sheath 90 comprises a first portion 16 (first stage) cooled to a first temperature for example of between 4 and 100 K (and for example equal to 50 K), and a second portion 17 (second stage) cooled to a second temperature of between 2 and 8 K (and for example equal to 4 K).

In addition, said injection line 12 is mechanically decoupled from the cryogenerator 4 and from the support 7, 8, that is to say that the injection line 12 is at least partially mechanically insulated from the vibrations generated by the cryogenerator 4.

Thus, the injection line 12 is not mechanically connected or fixed to the cryogenerator 4 directly, or to an element linked to the cryogenerator 4, without damping of the vibrations of the latter. For example, the injection line 12 is fixed to the enclosure 9, without contact with the support 7, 8.

Alternatively or cumulatively, the injection line 12 is fixed to an element in the sheath 90, said element being mechanically insulated from the vibrations of the cryogenerator 4. For example, the injection line 12 passes through the support 8 without touching it and/or the enclosure 9 and/or the sheath 90 via an insulated passage with one or more vibration insulation systems (seals, dampers, etc.). In the sheath 90, the injection line 12 may be fixed to an inner wall of the sheath 90 (for example by welding and/or gluing) and/or may be suspended in the sheath 90. In particular, the injection line 12 is not in mechanical contact at the level of the plates 16, 17 (cold stage(s) or exchangers) of the cryogenerator 4.

The injection line 12 is thermally coupled to the cryogenerator 4 by virtue of the gas present in the enclosure 9 which houses the cryogenerator 4. A continuous heat exchanger is thus obtained allowing the effective pre-cooling of the mixture constituting the cycle gas, while avoiding the transmission of vibrations to the lower stages of the device 1.

As illustrated, the at least one cycle gas cooling member may further comprise an additional cooling system located upstream of the inlet of the boiler 5, for example a cooler 50 of the Joule-Thomson type (or any other appropriate system, for example a 1-K pot).

The working circuit 2 further comprises a set of return lines 13, 130 connecting an outlet of the boiler 5 to an inlet of the transfer member 6 outside the cold box via a cycle gas passage in the sheath 90, the cycle fluid emerging and circulating in the volume of the sheath 90 in contact (directly) with the lower end of the cryogenerator 4.

For example, the set of return lines comprises a first portion of return line 13 opening out into the sheath 90 at a lower end of the sheath 90 in order to inject the cycle gas therein, and a second portion of return line 130 having a lower end communicating with an upper end of the sheath 90 in order to collect the cycle gas.

The set of return lines 13, 130 is also mechanically decoupled from the cryogenerator 4 and from the support 7, 8, that is to say at least partially mechanically insulated from the vibrations generated by the cryogenerator 4.

Thus, the cycle fluid (mixture of H3-He4 gases) circulates from bottom to top and exchanges directly with the injection line 2 and the heat exchangers 16, 17 of the cryogenerator 4. The heat exchangers 16, 17 are preferably thermalized (that is to say cooled) on the intermediate stages at 4 K and at 50 K and can thus recover the cold energy of the working gas returning from the boiler 5 and thus optimize the pre-cooling of the working fluid circulating in the opposite direction from top to bottom. Thus, the atmosphere in the sheath 90 surrounding the heat exchangers 16, 17 is therefore not composed of a static gas. This promotes the exchange of heat. This makes it possible to use less gas and to be able to descend to lower temperatures more easily (lower than 4 K, and for example equal to 2.8 K). This is obtained by maintaining a gaseous atmosphere in the volume of the sheath 90 around the cold part of the cryogenerator 4.

Alternatively, gas from this atmosphere may be liquefied and may form a bath at the bottom of the sheath 90.

This structure contributes to having little or no mechanical link with the cryogenerator 4 on the cold parts and therefore no transmission of vibrations.

Furthermore, the one same single type of gas can be used for the working gas and for this gaseous atmosphere in the sheath 90.

The lower end of the cryogenerator 4 may comprise at least one heat exchanger 17 for cooling cycle gas, notably from the atmosphere in the volume of the sheath 90. The first portion of return line 13 may advantageously open out below said heat exchanger 17 in order for the rising flow of cycle fluid to be oriented in contact with this heat exchanger 17.

Figure 3:
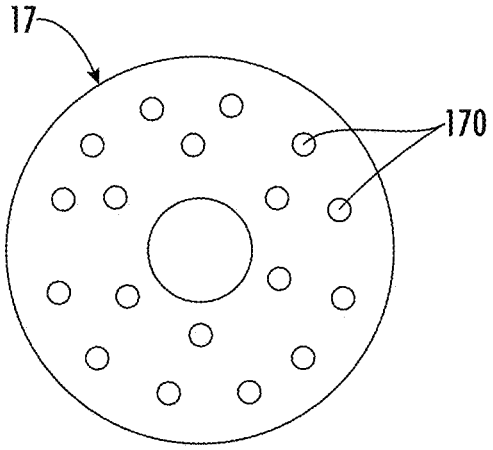
FIG. 3 shows a simplified, schematic and partial top view illustrating an example of the structure of a heat exchanger of the device.

This heat exchanger 17 may comprise a structure provided with passage(s), for example orifices 170 and/or fins oriented in the vertical direction to accommodate at least part of the cycle gas flow emerging via the first portion of return line 13 (cf. [FIG. 3]). This increases the efficiency of the heat exchanges between the different parts (notably fluid).

For example, the device 1 may be configured to maintain the pressure in the sheath 90 at a determined value, for example close to atmospheric pressure and notably between 0 and 2 bar. For example, the target pressure is the liquefaction pressure of helium at the coldest temperature of the cryogenerator 4 (for example 5 K, 4 K, 2.5 K, etc.).

The support may comprise a first base 8 mounted horizontally on a first set of legs 7, for example three legs (isostatic system).

Figure 2:
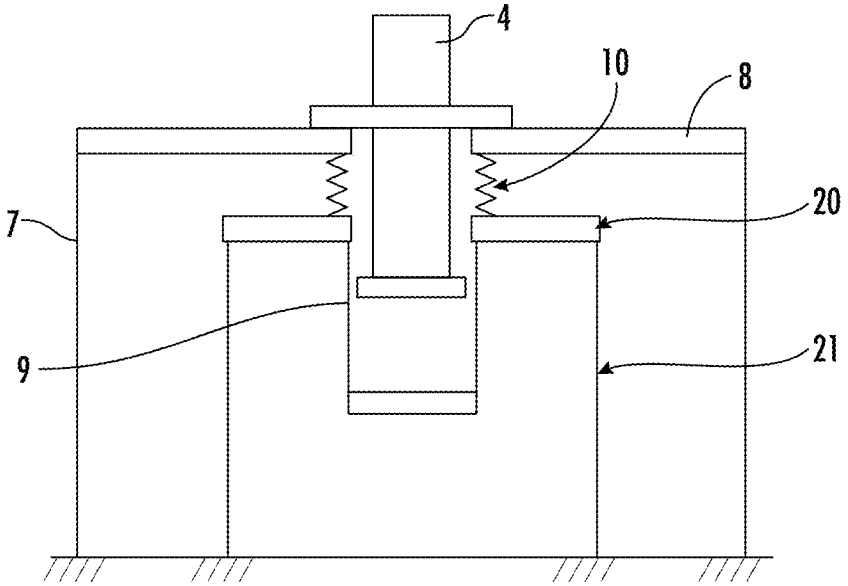
FIG. 2 shows a simplified, schematic and partial view illustrating another example of a support structure for such a device.

As shown schematically in [FIG. 2], the support may comprise a second base 20 located under the first base 8 and mounted on a second set of legs 21, for example three legs. The two ends of the bellows 10 may be connected respectively to the first base 8 and second base 20. The second base 20 is for example connected to the first base 8 by the bellows 10, the enclosure 9 being for example mechanically connected to the second base 20.

This structure with dual isostatic frames makes it possible to better decouple the reactions of force and vibrations in the device 1.

The sets 7, 8 and 20, 21 may be fixed to the same reference surface or to two different respective reference surfaces.

Posts or pillars, for example three thereof, may also be provided in parallel with the bellows 10 to avoid any potential damage to the bellows 10 and the other components both during transport and during installation, maintenance and operation of the device 1. It is possible to use a horizontal clearance (in the XY plane) between each pillar and a respective flange to verify the correct alignment of the installation.

The vertical clearance (in Z) can be eliminated or enabled ("transport" mode or "operating" mode, for example). In "operating" mode, the vertical clearance can make it possible to release/optimize the work of the bellows 10 while maintaining a safety function which prevents the bellows 10 from being crushed in the event of failure.

The device has other advantages over the prior art. Thus, for example, improved ease of maintenance. Specifically, it suffices to disassemble (screws or other) at 300 K to be able to carry out work on the cryogenerator 4 on the support, by virtue of the absence of mechanical contact between the cryogenerator and the other cold elements of the device 1.

The device may comprise a pump or a cryogenic compressor for the circulation of the flow of working fluid, for example at the first cold stage of the circuit (temperature for example at 77 K or 50 K or 4 K), in addition to or replacing an external pump, in order to increase the pressure in the working circuit 2 and maintain a more efficient heat exchange regime.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A dilution refrigeration device comprising:

a working circuit in the form of a loop containing a cycle fluid, the cycle fluid comprising a mixture of helium-3 (3He) and helium-4 (4He), the working circuit comprising a mixing chamber, a boiler and a transfer member, which are disposed in series and fluidically connected via a set of lines, the working circuit being configured to connect an outlet of the mixing chamber to an inlet of the boiler and an outlet of the boiler to an inlet of the transfer member, the working circuit also being configured to connect an outlet of the transfer member to an inlet of the mixing chamber;

at least one cooling member which is in heat exchange with the working circuit and is configured to transfer cold energy to the cycle fluid, the at least one cooling member comprising a cryogenerator;

a support, a fluid-tight enclosure, an open end of the fluid-tight enclosure being mechanically connected to the support via a fluid-tight flexible bellows;

an upper end of the cryogenerator being fixed to the support; and a fluid-tight sheath housed in the fluid-tight enclosure, a lower end of the cryogenerator extending in the fluid-tight sheath inside the fluid-tight flexible bellows such that the fluid-tight enclosure and the fluid-tight sheath are at least partially mechanically insulated from vibrations generated by the cryogenerator, wherein the working circuit comprises a fluid injection line connecting the outlet of the transfer member to the inlet of the mixing chamber via a fluid-tight passage in the fluid-tight sheath, the injection line being mechanically decoupled from the cryogenerator and from the support, such that the injection line is at least partially mechanically insulated from the vibrations generated by the cryogenerator, wherein the working circuit further comprises a set of return lines connecting the outlet of the boiler to the inlet of the transfer member outside the fluid-tight enclosure via a cycle gas passage in the fluid-tight sheath, in the cycle gas passage the cycle fluid emerges and circulates in the volume of the fluid-tight sheath in contact with the lower end of the cryogenerator.

2. The device as claimed in claim 1, wherein the injection line is in heat exchange with the cryogenerator and with the cycle fluid which circulates in the fluid-tight sheath between the outlet of the boiler and the inlet of the transfer member.

3. The device as claimed in claim 1, wherein the set of return lines comprises a first portion of return line opening out into the fluid-tight sheath at a lower end of the fluid-tight sheath in order to inject the cycle gas therein, and a second portion of return line having a lower end communicating with an upper end of the fluid-tight sheath in order to collect the cycle gas.

4. The device as claimed in claim 1, wherein the set of return lines is mechanically decoupled from the cryogenerator and from the support, that is to say at least partially mechanically insulated from the vibrations generated by the cryogenerator.

5. The device as claimed in claim 1, wherein the injection line is fixed to an inner wall of the fluid-tight sheath and/or suspended in the fluid-tight sheath.

6. The device as claimed in claim 1, wherein the mixing chamber and the boiler are mounted in a shell and/or a container that are/is located in the fluid-tight enclosure, the transfer member being located outside the fluid-tight enclosure.

7. The device as claimed in claim 1, wherein, in an operating configuration, the lower end of the cryogenerator comprises a first portion cooled to a first temperature of between 4 and 100 K, and a second portion cooled to a second temperature of between 2 and 8 K.

8. The device as claimed in claim 1, wherein the at least one cooling member comprises an additional cooling system located at the inlet upstream of the boiler.

9. The device as claimed in claim 1, wherein support comprises a first base mounted on a first set of legs, for example three legs.

10. A dilution refrigeration method using a device as claimed in claim 1, the method comprising the steps of:

generating cold by way of the cryogenerator;

circulating the cycle fluid in the working circuit;

wherein the method further comprises at least one step from among:

regulating the quantity of gas in the fluid-tight sheath, regulating the pressure in the fluid-tight sheath to a determined value that is between 0 and 2 bar, and regulating the pressure in the fluid-tight sheath to a pressure corresponding to the liquefaction pressure of helium-4 at the coldest temperature of the cryogenerator.

11. The device as claimed in claim 3, wherein the lower end of the cryogenerator comprises at least one heat exchanger for cooling cycle gas, the first portion of return line opening out below said heat exchanger in order for the flow of cycle fluid injected into the fluid-tight sheath to be oriented in contact with the at least one heat exchanger.

12. The device as claimed in claim 11, wherein the at least one heat exchanger comprises, within its thickness, one or more passages, for example orifices and/or fins oriented in the vertical direction to accommodate at least part of the cycle gas flow emerging via the first portion of return line.

13. The device as claimed in claim 9, wherein the support comprises a second base located under the first base and mounted on a second set of legs, for example three legs, two ends of the fluid-tight flexible bellows being connected respectively to the first base and second base.

14. The device as claimed in claim 13, wherein the fluid-tight enclosure is mechanically connected to the second base.

* * * * *